US011357283B2

(12) United States Patent
Jang et al.

(10) Patent No.: US 11,357,283 B2
(45) Date of Patent: Jun. 14, 2022

(54) VENTILATING SHOE CAPABLE OF BEING PUMPED BY USING OUTSOLE

(71) Applicants: Chang-Won Jang, Seoul (KR); Jun-Yun Won, Seoul (KR)

(72) Inventors: Chang-Won Jang, Seoul (KR); Jun-Yun Won, Seoul (KR)

( * ) Notice: Subject to any disclaimer, the term of this patent is extended or adjusted under 35 U.S.C. 154(b) by 0 days.

(21) Appl. No.: 14/408,946

(22) PCT Filed: Sep. 27, 2013

(86) PCT No.: PCT/KR2013/008659

§ 371 (c)(1),
(2) Date: Dec. 17, 2014

(87) PCT Pub. No.: WO2014/051368

PCT Pub. Date: Apr. 3, 2014

(65) Prior Publication Data

US 2015/0201700 A1 Jul. 23, 2015

(30) Foreign Application Priority Data

Sep. 29, 2012 (KR) ..... 10-2012-0109584

(51) Int. Cl.

| | |
|---|---|
| ***A43B 7/06*** | (2006.01) |
| ***A43B 7/08*** | (2022.01) |
| ***A43B 13/14*** | (2006.01) |

(52) U.S. Cl.

CPC ..... *A43B 7/06* (2013.01); *A43B 7/081* (2013.01); *A43B 7/084* (2013.01); *A43B 13/145* (2013.01)

(58) Field of Classification Search

CPC .. A43B 7/06; A43B 7/08; A43B 7/081; A43B 7/082; A43B 7/084; A43B 7/105; A43B 17/08

USPC ..... 36/3 R, 3 B, 28

See application file for complete search history.

(56) References Cited

U.S. PATENT DOCUMENTS

| | | | | |
|---|---|---|---|---|
| 5,138,775 | A * | 8/1992 | Chu | A43B 7/06 36/3 B |
| 5,813,140 | A * | 9/1998 | Obeid | 36/3 R |
| 5,860,225 | A * | 1/1999 | O'Dwyer | 36/27 |
| 5,996,250 | A * | 12/1999 | Reed et al. | 36/3 R |

(Continued)

FOREIGN PATENT DOCUMENTS

| | | |
|---|---|---|
| JP | 2006192218 | 7/2006 |
| KR | 2019920014589 | 8/1992 |

(Continued)

*Primary Examiner* — Sharon M Prange
(74) *Attorney, Agent, or Firm* — IPLA P.A.

(57) ABSTRACT

Provided is a ventilated shoe. The shoe includes an upper. An outsole has an upper edge end provided on an upper sole part, an air chamber provided inside the upper edge end, and an ascending and descending edge surface provided on an outer edge of a lower sole part in such a way as to be inclined outwards and upwards from a bottom surface, the outer edge of the lower sole part being provided under the upper edge end to be opposite thereto. An insole is secured to the upper edge end to cover a top of the air chamber, with a plurality of ventilation holes being formed in a front portion thereof. A backflow prevention valve prevents outside air supplied to the air chamber from flowing backwards. An air inlet pipe supplies the outside air to the backflow prevention valve.

5 Claims, 6 Drawing Sheets

(56) References Cited

U.S. PATENT DOCUMENTS

| | | | | |
|---|---|---|---|---|
| 6,044,577 | A * | 4/2000 | Clark | 36/3 B |
| 6,079,123 | A * | 6/2000 | Clark | 36/3 B |
| 6,305,099 | B1 * | 10/2001 | Chu | 36/3 B |
| 7,578,074 | B2 * | 8/2009 | Ridinger | 36/3 R |
| 8,074,374 | B2 * | 12/2011 | Chang | 36/3 B |
| 2005/0005473 | A1 * | 1/2005 | Oh | 36/29 |
| 2008/0189986 | A1 * | 8/2008 | Elnekaveh | 36/102 |
| 2010/0095553 | A1 * | 4/2010 | Elnekaveh | 36/102 |
| 2010/0186263 | A1 * | 7/2010 | Lee | 36/3 B |
| 2012/0110871 | A1 * | 5/2012 | Elnekaveh | 36/87 |

FOREIGN PATENT DOCUMENTS

| | | |
|---|---|---|
| KR | 2001967570000 | 7/2000 |
| KR | 2003134230000 | 5/2003 |
| KR | 1020050045974 | 5/2005 |
| KR | 2004260610000 | 9/2006 |
| KR | 100918108 | 9/2009 |
| KR | 1020120016034 | 2/2012 |
| KR | 101147675 | 5/2012 |

* cited by examiner

[Fig. 1]
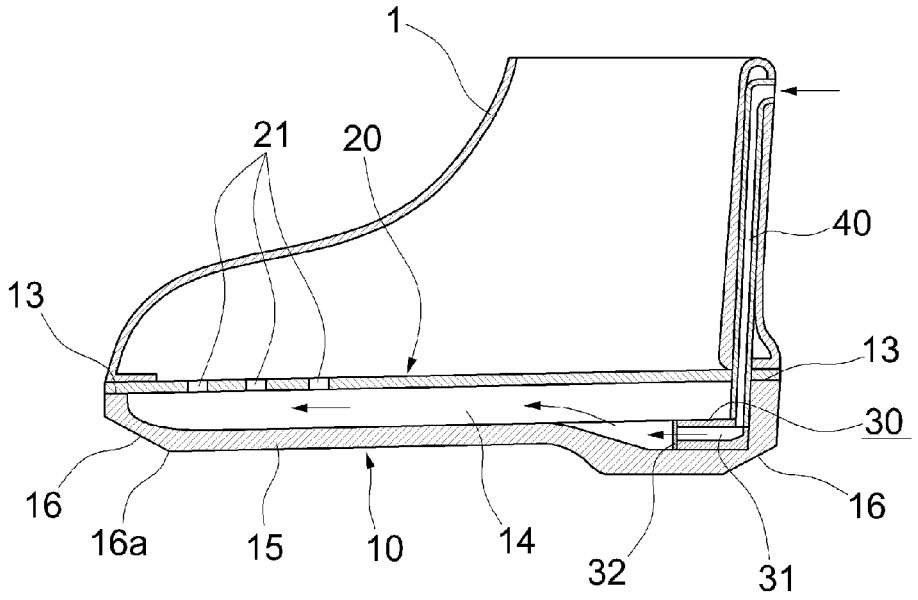

[Fig. 2]
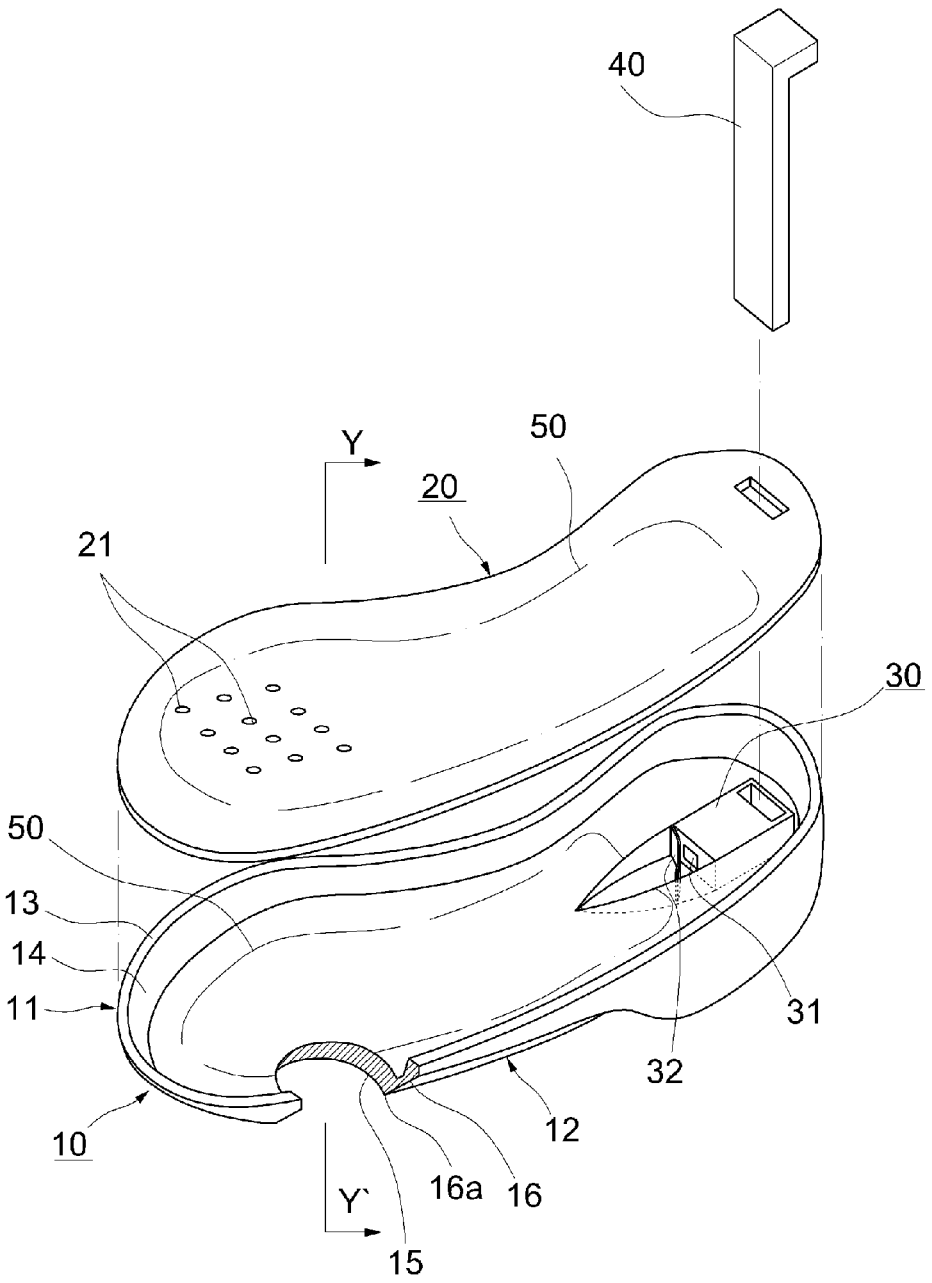

[Fig. 3]
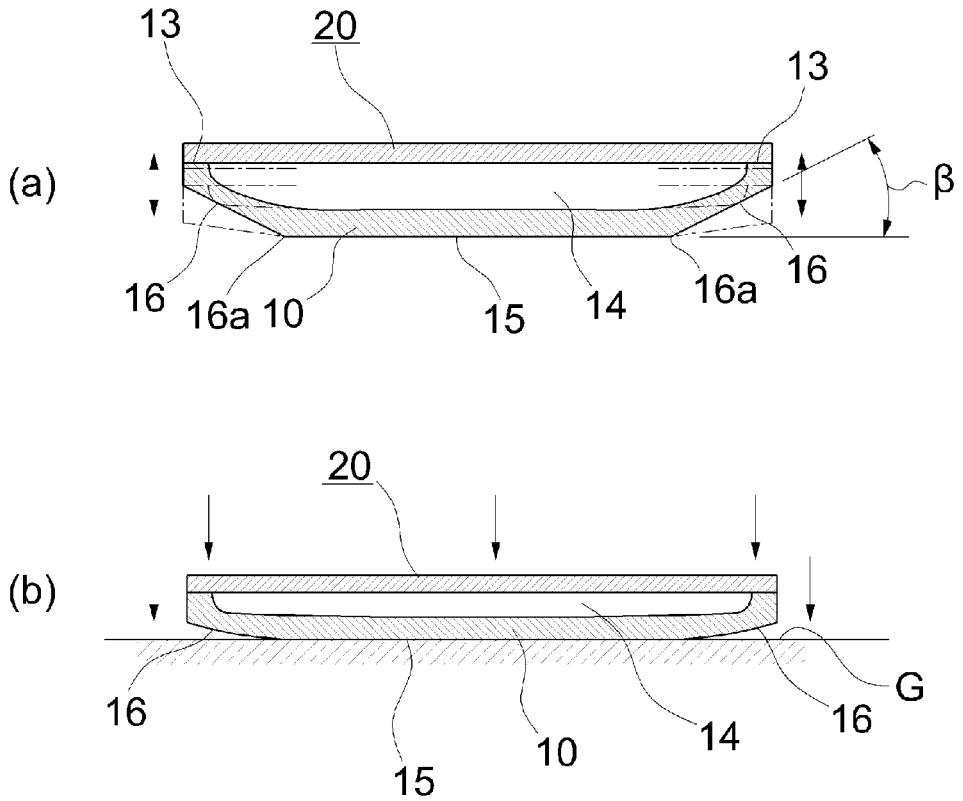

[Fig. 4]
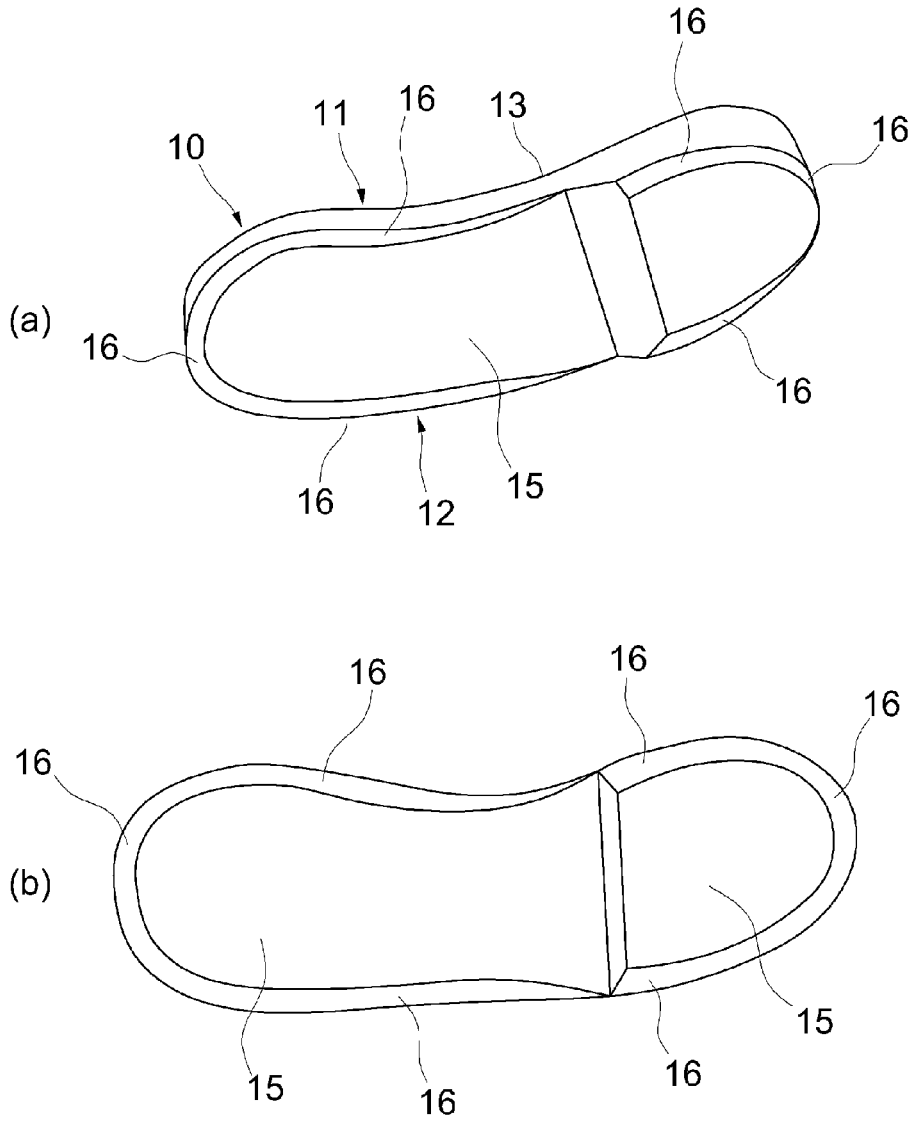

[Fig. 5]
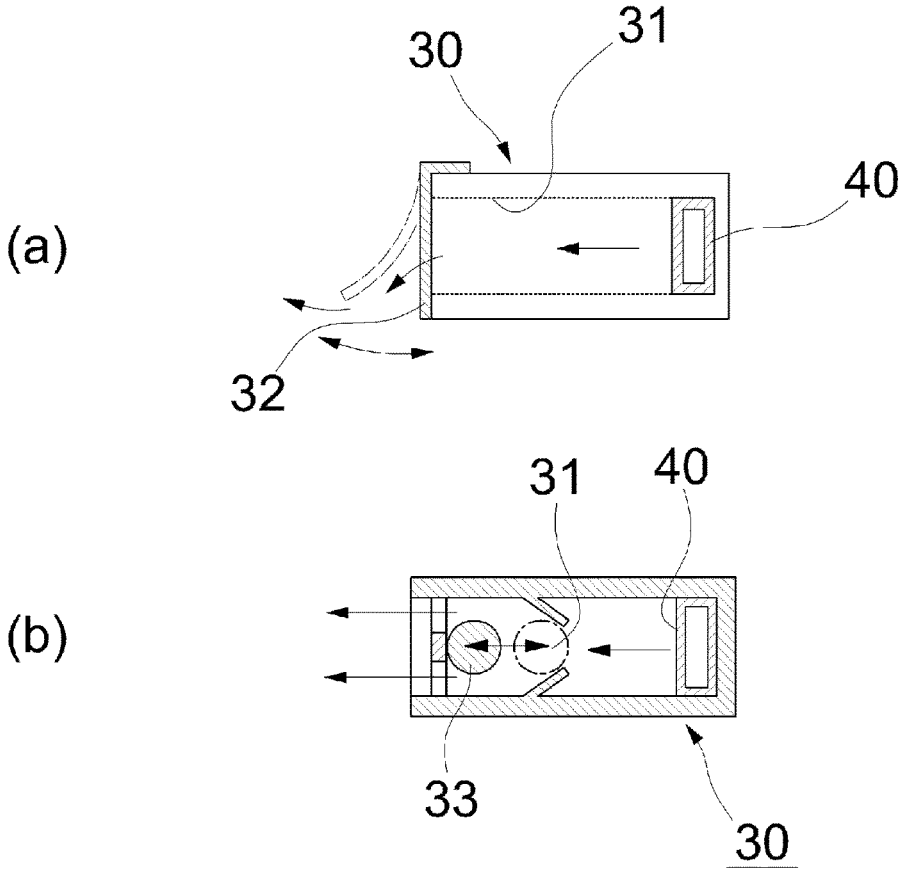
[Fig. 6]
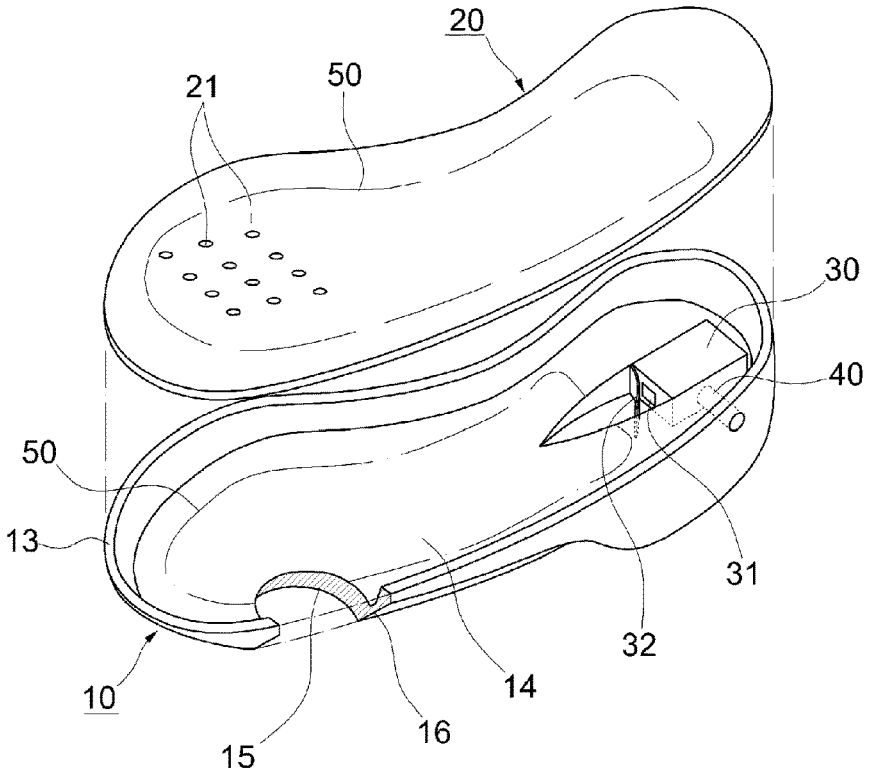

[Fig. 7]
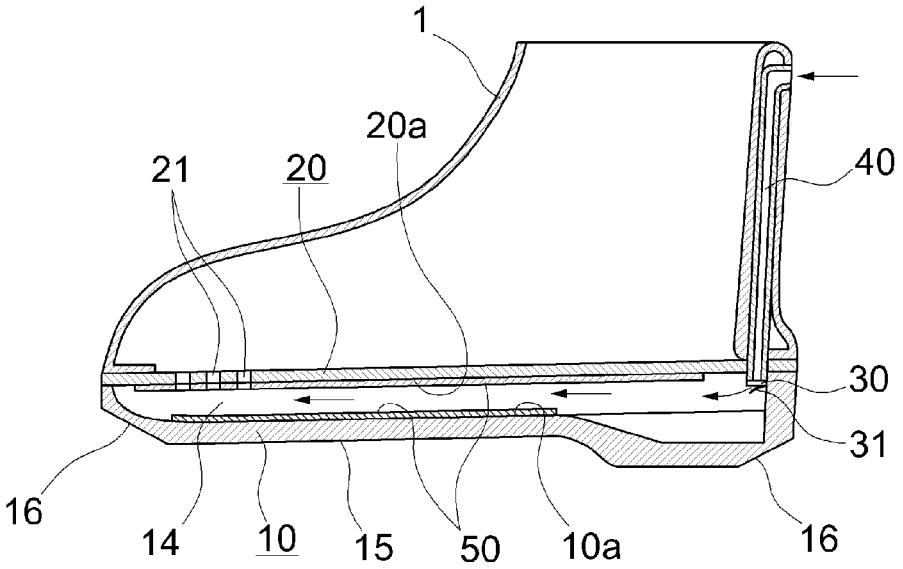
[Fig. 8]
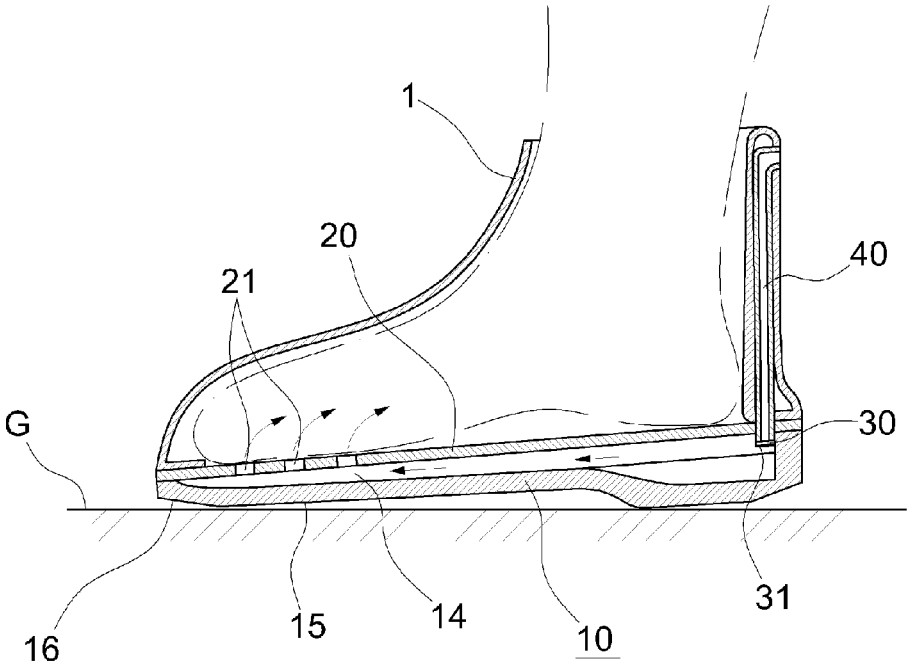

VENTILATING SHOE CAPABLE OF BEING PUMPED BY USING OUTSOLE

BACKGROUND

The present invention relates, in general, to ventilated shoes and, more particularly, to a ventilated shoe capable of supplied with air via a pumping action of an outsole, which is improved in structure to perform a ventilating action.

Generally, most ventilated shoes are configured such that an air tube is installed in a shoe to perform a pumping operation and an insole is provided to move vertically, thus carrying out the ventilation of the shoe, as described in the documents of the related art.

Further, there are proposed shoes, which are configured such that an elastic member, such as a spring, is provided in a shoe to perform an elastic operation vertically, thus carrying out the ventilation of the shoe.

However, the conventional ventilated shoes are problematic in that the air tube or the elastic member should be installed therein, resulting in the requirement of extensive manufacturing processes, thus weakening competitiveness due to an increase in manufacturing cost, and reducing durability and product life; thereby leading to a reduction in marketability.

Hence, although it may seem obvious that a ventilated shoe is much better than a general shoe having no ventilating function, it is difficult to overcome the problems of the conventional ventilated shoes, such as the reduction in durability, the increase in purchase price, or the reduction in product life. Thereby, the ventilated shoe is not practically commercialized yet.

Therefore, the inventors of the present invention developed a ventilated shoe, which achieves an increase in productivity, a reduction in manufacturing cost, and an increase in product life.

Documents of Related Art (Patent Document 1) KR 20-1993-0005060 Y1 1993 Aug. 4

(Patent Document 2) KR 10-2005-0045974 A 2005 May 17

(Patent Document 3) KR 10-2012-0016034 A 2012 Feb. 22

(Patent Document 4) KR 10-1147675 B1 2012 May 21

SUMMARY OF THE INVENTION

Accordingly, the present invention has been made keeping in mind the above problems occurring in the related art, and is intended to provide a ventilated shoe which is capable of being supplied with air via a pumping action of an outsole, so as to be ventilated using the outsole.

Further, the present invention serves to provide a ventilated shoe, which is improved in productivity, has a reduced manufacturing cost, and is improved in quality, thus enabling the commercialization of the shoe.

Technical Solution

In an aspect, the present invention provides a ventilated shoe capable of being supplied with air via a pumping action of an outsole, including an upper; an outsole having an upper edge end provided on an upper sole part, an air chamber provided inside the upper edge end, and an ascending and descending edge surface provided on an outer edge of a lower sole part in such a way as to be inclined outwards and upwards from a bottom surface, the outer edge of the lower sole part being provided under the upper edge end to be opposite thereto; an insole secured to the upper edge end to cover a top of the air chamber, with a plurality of ventilation holes being formed in a front portion thereof; a backflow prevention valve preventing outside air supplied to the air chamber from flowing backwards; and an air inlet pipe supplying the outside air to the backflow prevention valve.

A boundary point at which the ascending and descending edge surface meets the bottom surface may be positioned to be inside the upper edge end, and the ascending and descending edge surface may have an inclination angle of 10 to 45° with the bottom surface.

A sound absorption member may be attached to each of an inner surface on a bottom of the air chamber of the outsole and an inner surface of the insole, or the sound absorption member may be attached to either of the inner surface of the outsole or the inner surface of the insole.

As described above, the ventilated shoe according to the present invention is advantageous in that it ensures a smooth and better pumping action using the outsole unlike the current ventilated shoes of the related art having a separate air bag.

Further, the ventilated shoe according to the present invention is advantageous in that it is possible to ensure a ventilating action only using essential components of the shoe, that is, the outsole and the insole without the presence of the conventional air bag, thus improving productivity and reducing manufacturing cost thereof and thereby allowing a shoe having a ventilating function to be produced at low cost. Consequently, the commercialization of the shoe is achieved.

BRIEF DESCRIPTION OF DRAWINGS

FIG. 1 is a side sectional view showing a ventilated shoe according to the present invention;

FIG. 2 is an exploded perspective view showing important parts of the ventilated shoe according to the present invention;

FIGS. 3*a* and 3*b* are sectional views taken along line Y-Y' of FIG. 2 to illustrate the operation of the ventilated shoe;

FIGS. 4*a* and 4*b* are a perspective view and a bottom view showing an outsole of the ventilated shoe according to the present invention, respectively;

FIGS. 5*a* and 5*b* are sectional views showing a backflow prevention valve adopted to the present invention;

FIG. 6 is an exploded perspective view showing a ventilated shoe adopting an air inlet pipe according to another embodiment of the present invention;

FIG. 7 is a sectional view showing another backflow prevention valve and a sound absorption member according to the present invention; and FIG. 8 is a sectional view illustrating an operation when the ventilated shoe according to the present invention comes into contact with the ground.

*Description of reference numerals of important parts*

| | |
|---|---|
| 1: upper | 10: outsole |
| 11: upper sole part | 12: lower sole part |
| 13: upper edge end | 14: air chamber |
| 15: bottom surface | 16: ascending and descending edge end |
| 16a: boundary point | 20: insole |
| 21: ventilation hole | 30: backflow prevention valve |
| 31: air passage | 32: opening and closing sheet |
| 33: ball | 40: air inlet pipe |
| 50: sound absorption member | |

DETAILED DESCRIPTION OF THE INVENTION

Hereinbelow, preferred embodiments of the present invention will be described in detail with reference to the accompanying drawings.

Referring to FIGS. 1 and 2, the ventilated shoe of the present invention includes an upper 1, an outsole 10, and an insole 20.

The outsole 10 is made of a rubber member having elasticity, and has on an upper sole part 11 thereof, an upper edge end 13.

The outsole 10 is configured to further include an air chamber 14 that is defined inside the upper edge end 13, and an ascending and descending edge surface 16 that is provided on an outer edge of a lower sole part 12 in such a way as to be inclined outwards and upwards from a bottom surface 15, the outer edge of the lower sole part being provided under the upper edge end to be opposite thereto.

Further, as shown in FIG. 3*a*, a boundary point 16*a* at which the ascending and descending edge surface 16 meets the bottom surface 15 is positioned to be inside the upper edge end 13.

The ascending and descending edge surface 16 is inclined upwards from the bottom surface 15. Preferably, the ascending and descending edge surface 16 has an inclination angle β of 10 to 45° with the bottom surface 15.

Further, as shown in FIGS. 4*a* and 4*b*, the ascending and descending edge surface 16 may be provided along an entire edge of the outsole 10. However, in the case of a shoe having a heel portion, the ascending and descending edge surface 16 may be provided on a portion except the heel portion.

Further, the ascending and descending edge surface 16 preferably has a straight-line shape. However, the ascending and descending edge surface 16 may have other shapes including a curved shape as long as it is aligned with the bottom surface 15 in a line.

Turning back to FIG. 1, the insole 20 has on a front portion thereof a plurality of ventilation holes 21, and is secured to the upper edge end 13 to cover a top of the air chamber 14 of the outsole 10.

Such an insole 20 is preferably made of a hard material that is not easily bendable. However, the invention is not limited thereto.

Further, the shoe of the present invention includes a backflow prevention valve 30 that serves to prevent outside air supplied to the air chamber 14 from flowing backwards, and an air inlet pipe 40 that serves to supply the outside air to the backflow prevention valve 30.

As shown in FIG. 1, the backflow prevention valve 30 is secured to the outsole 10 in such a way as to be in a rear portion of the air chamber 14. The air inlet pipe 40 is accommodated in a rear portion of the upper 1 in such a way as to be connected to the backflow prevention valve 30.

As shown in FIG. 5*a*, the backflow prevention valve 30 has an opening and closing sheet 32 on a front of the air passage 31. Here, one end of the opening and closing sheet 32 is secured to the backflow prevention valve 30, while the other end becomes a free end.

In this case, as the outside air drawn into the air inlet pipe 40 flows through the air passage 31 into the air chamber 14, the free end of the opening and closing sheet 32 moves away from the air passage as shown by the imaginary line of FIG. 5*a*. Thereby, the air passage 31 is opened, so that it is ready to draw the outside air into the air chamber 14.

However, when the air of the air chamber 14 blows to the backflow prevention valve 30, the opening and closing sheet 32 is pushed towards the air passage. Thereby, as shown by the solid line of FIG. 5*a*, the free end of the opening and closing sheet 32 comes into close contact with the air passage 31 to close it and thereby prevent the air in the air chamber 14 from flowing backwards into the air passage 31.

Meanwhile, as shown in FIG. 5*b*, the backflow prevention valve 30 of the present invention may be configured such that the air passage 31 is opened or closed by a ball 33.

In this case, if the outside air is drawn into the air inlet pipe 40, it pushes the ball 33, so that the air passage 31 is opened as shown by the solid line of FIG. 5*b* and thereby the outside air is supplied to the air chamber 14 through the air passage 31. In contrast, if the air in the air chamber 14 tries to flow back into the air passage 31, the ball 33 is moved as shown by the imaginary line of FIG. 5*b* by a pressure of the air that passes through the air passage 31, thus closing the air passage 31 and preventing the air drawn into the air chamber 14 from flowing back into the air inlet pipe 40.

The backflow prevention valve 30 is already known to those skilled in the art. The present invention may adopt any valve as long as it has the same function as the above-mentioned backflow prevention valve 30.

Meanwhile, the air inlet pipe 40 may be provided on a side of the outsole 20 in such a way as to be connected to the backflow prevention valve 30 as shown in FIG. 6. The backflow prevention valve 30 may be secured to an inner surface of the insole 20 in the air chamber 14 in such a way as to be connected to the air inlet pipe 40, as shown in FIG. 7.

Therefore, according to the present invention, the backflow prevention valve 30 and the air inlet pipe 40 may be modified into various shapes, i.e. may have adopt any structure as long as it allows outside air to be supplied to the air chamber 14 and prevents air in the air chamber 14 from flowing back into the air inlet pipe 40.

Further, as shown in FIG. 7, the shoe of the present invention is configured such that a sound absorption member 50 is attached to each of an inner surface 10*a* on a bottom of the air chamber 14 of the outsole 10 and an inner surface 20*a* of the insole 20. Alternatively, the shoe may be configured such that the sound absorption member 50 is attached to either of the inner surface 10*a* of the outsole 10 or the inner surface 20*a* of the insole 20.

The sound absorption member 50 comprises non-woven fabric, and serves to absorb the sound of air flow that is generated when the air in the air chamber 14 is pressurized and flows in the air chamber 14 at high speed so as to be discharged through the ventilation holes 21, thus preventing the sound from getting out.

Thus, while a wearer walks with the shoe on, the bottom surface 15 of the outsole 10 comes into contact with the ground G as shown in FIG. 8. Then, his or her weight is put on the outsole 10, thus causing the ascending and descending edge surface 16 to be pressed down to the ground G as shown in FIG. 3*b*. Here, since the outsole 10 and the insole 20 have elasticity and flexibility, a good compression state is ensured.

As the insole 20 moves down while the ascending and descending edge surface 16 is compressed and moved down to the ground G, the air chamber 14 is compressed, so that the air in the air chamber 14 is blown through the ventilation holes 21 into the upper 1.

Of course, the backflow prevention valve 30 is closed by the opening and closing sheet 32, so that the air in the air chamber 14 is blown only to the ventilation holes 21 without flowing back into the air inlet pipe 40, thus ensuring a good ventilating action.

Further, if the shoe is raised from the ground G during walking, the compressed ascending and descending edge surface 16 is restored to its original state because the outsole 10 is made of the elastic material. Thereby, the air chamber 14 is enlarged as shown in FIGS. 3*a* and 7, with the result that a suction force for sucking the outside air into the air chamber 14 is generated.

Thus, the free end of the opening and closing sheet 32 of the backflow prevention valve 30 moves outwards, so that the air passage is opened and simultaneously fresh outside air is drawn into the air chamber 14 through the air inlet pipe 40.

Further, as described above, if a wearer steps on the ground G with the shoe again, the ascending and descending edge surface 16 of the outsole 10 is compressed again, so that the air in the air chamber 14 is blown into the upper 1 through the ventilation holes 21 and thereby the ventilating action is achieved. As he or she walks with the shoe on, the ascending and descending edge surface 16 is compressed to descend and is restored to ascend. As such, a pumping action is continuously performed to compress or expand the air chamber 14 during walking.

Therefore, the present invention provides the shoe that ensures a smooth and better pumping action without the air bag (air tube) unlike the conventional shoe.

Further, the present invention provides a ventilated shoe that can be ventilated by essential components of the shoe, namely, the outsole 10 and the insole 20 without using the conventional air bag, thus achieving a reduction in manufacturing cost and allowing consumers to purchase a ventilated shoe at low cost.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A ventilated shoe, comprising:

an upper (1);

an outsole (10) comprising:

an upper edge end (13) provided on an upper sole part (11);

an air chamber (14) provided inside the upper edge end (13); and an ascending and descending edge surface (16) provided on an outer edge of a lower sole part (12) in such a way as to be inclined outwards and upwards from a bottom surface (15), the outer edge of the lower sole part being provided under the upper edge end (13) to be opposite thereto;

an insole (20) secured to the upper edge end (13) to cover a top of the air chamber (14), with a plurality of ventilation holes (21) being formed in a front portion thereof;

a backflow prevention valve (30) preventing outside air supplied to the air chamber (14) from flowing backwards; and an air inlet pipe (40) supplying the outside air to the backflow prevention valve (30) wherein the ventilated shoe is supplied with air via a pumping action of the outsole, wherein the backflow prevention valve (30) is secured to the outsole (10) in such a way as to be in a rear portion of the air chamber (14), wherein the air chamber (14) is disposed between the outsole (10) and the insole (20) and substantially all across the outsole (10), lengthwise and widthwise, and wherein, when the insole (20) is stepped on the ascending and descending edge surface (16) is configured to be pressed down to the ground (G), so that the air chamber (14) is compressed, so that air in the air chamber (14) is blown through the plurality of ventilation holes (21) into the upper (1).

2. The ventilated shoe according to claim 1, wherein a boundary point (16*a*) at which the ascending and descending edge surface (16) meets the bottom surface (15) is positioned to be inside the upper edge end (13), and the ascending and descending edge surface (16) has an inclination angle of 10 to 45° with the bottom surface (15).

3. The ventilated shoe according to claim 1, wherein a sound absorption member (50) is attached to each of an inner surface (10*a*) on a bottom of the air chamber (14) of the outsole (10) and an inner surface (20*a*) of the insole (20), or the sound absorption member (50) is attached to either of the inner surface (10*a*) of the outsole (10) or the inner surface (20*a*) of the insole (20).

4. The ventilated shoe according to claim 3, wherein the sound absorption member is formed of a non-woven fabric.

5. A ventilated shoe, comprising:

an upper (1);

an outsole (10) comprising:

an upper edge end (13) provided on an upper sole part (11);

an air chamber (14) provided inside the upper edge end (13); and an ascending and descending edge surface (16) provided on an outer edge of a lower sole part (12) in such a way as to be inclined outwards and upwards from a bottom surface (15), the outer edge of the lower sole part being provided under the upper edge end (13) to be opposite thereto, wherein the ascending and descending edge surface is flattened so as to compress the air chamber;

an insole (20) secured to the upper edge end (13) to cover a top of the air chamber (14), with a plurality of ventilation holes (21) being formed in a front portion thereof;

a backflow prevention valve (30) preventing outside air supplied to the air chamber (14) from flowing backwards; and an air inlet pipe (40) supplying the outside air to the backflow prevention valve (30), wherein the ventilated shoe is supplied with air via a pumping action of the outsole, wherein the backflow prevention valve (30) is secured to the outsole (10) in such a way as to be in a rear portion of the air chamber (14), and wherein, when the insole (20) is stepped on while the outsole (10) comes in contact with a ground (G), the ascending and descending edge surface (16) is configured to be pressed down to the ground (G), so that the air chamber (14) is compressed, so that air in the air chamber (14) is blown through the plurality of ventilation holes (21) into the upper (1).

* * * * *